US010239584B2

(12) United States Patent
Brammer et al.

(10) Patent No.: US 10,239,584 B2
(45) Date of Patent: Mar. 26, 2019

(54) MULTI-LAYER HATCH COVER SUPPORT PAD

(71) Applicant: CARGO CARE SOLUTIONS B.V., Rotterdam (NL)

(72) Inventors: Torben Brammer, Vordingborg (DK); Peter Peltenburg, Schoonhoben (NL)

(73) Assignee: Cargo Care Solutions B.V., Rotterdam (NL)

( * ) Notice: Subject to any disclaimer, the term of this patent is extended or adjusted under 35 U.S.C. 154(b) by 156 days.

(21) Appl. No.: 15/319,497

(22) PCT Filed: Jun. 18, 2014

(86) PCT No.: PCT/IB2014/062344
§ 371 (c)(1),
(2) Date: Dec. 16, 2016

(87) PCT Pub. No.: WO2015/193703
PCT Pub. Date: Dec. 23, 2015

(65) Prior Publication Data

US 2017/0190386 A1 Jul. 6, 2017

(51) Int. Cl.
*B63B 19/14* (2006.01)
*B63B 19/18* (2006.01)

(52) U.S. Cl.
CPC ..... *B63B 19/14* (2013.01); *B63B 19/18* (2013.01); *B63B 2019/185* (2013.01); *B63B 2704/00* (2013.01)

(58) Field of Classification Search
None
See application file for complete search history.

(56) References Cited

U.S. PATENT DOCUMENTS 4,096,207 A * 6/1978 Saxon ..... C08L 9/02 525/199
5,225,812 A * 7/1993 Faghri ..... B63B 11/04 114/228
2004/0021564 A1 2/2004 Houston et al.
2011/0309628 A1* 12/2011 Corts ..... F16C 17/06 290/55

FOREIGN PATENT DOCUMENTS

DE 39 04 602 A1 8/1989
DE 43 37 365 A1 5/1994

OTHER PUBLICATIONS

English machine translation of DE 4337365, created Jul. 19, 2018. (Year: 2018).*
Budinski, "Resistance to particle abrasion of selected plastics", Wear, vol. 203-204, p. 302-309, 1997. (Year: 1997).*

* cited by examiner

*Primary Examiner* — Christopher M Rodd
(74) *Attorney, Agent, or Firm* — Birch, Stewart, Kolasch & Birch, LLP

(57) ABSTRACT

The invention provides a multi-layer hatch cover support pad for supporting a hatch cover on a coaming structure of a ship. The multi-layer hatch cover support pad comprises an outer wear surface for sliding against a mating surface provided on the hatch cover or the coaming structure, a wear layer comprising first and second opposite sides, the first side defining the outer wear surface, the wear layer comprising a first plastic material, and, a base layer comprising third and fourth opposite sides, the third side being joined to the second side. The base layer comprises a second polymer material which is less abrasion resistant than the first plastic material. By making the base layer, which in practice makes up the main part of the multi-layer hatch cover support pad, out of the second polymer material, the cost of the multi-layer hatch cover support pad is decreased. The multi-layer hatch cover support pad may further comprise an internal wear indicator body for indicating wear of the wear layer and/or an identification unit for identifying the multi-layer hatch cover support pad. A method of producing the multi-layer hatch cover support pad, as well as a use of the multi-layer hatch cover support pad, is also provided.

17 Claims, 5 Drawing Sheets

MULTI-LAYER HATCH COVER SUPPORT PAD

Figure 1:
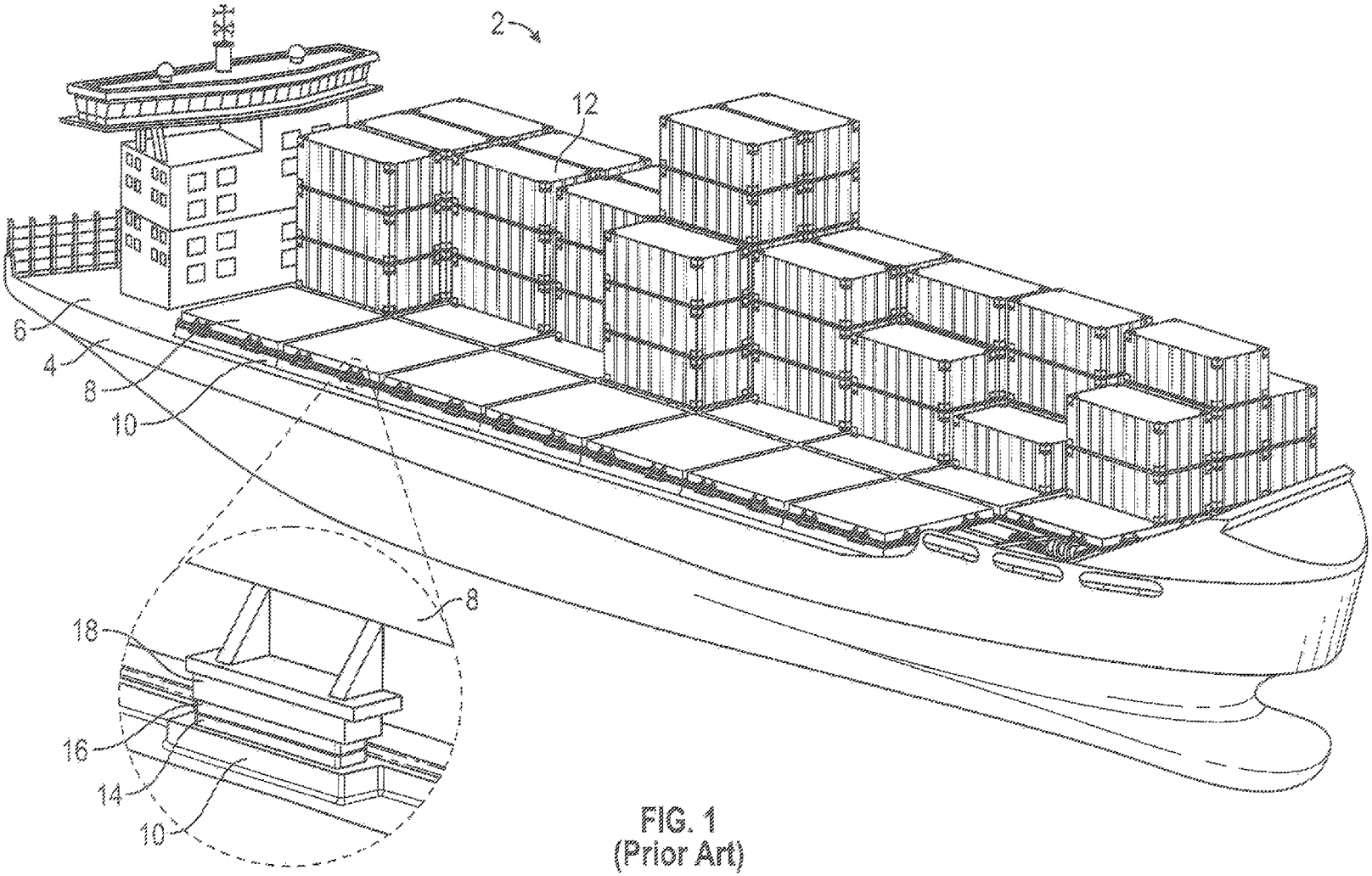
FIG. 1 (Prior Art)

The present invention concerns a multi-layer hatch cover support pad for supporting a hatch cover on a coaming structure of a ship. More particularly the present invention concerns a multi-layer hatch cover support pad comprising a wear layer and a base layer.

Cargo ships use hatch covers to selectively provide access to the inner parts of the ship, i.e. the cargo holds, through hatch openings provided on the decks of the ships. The cargo holds are bordered by the coaming structure, i.e. the vertical wall provided around the hatch opening to prevent water on the deck from running into the cargo holds. Hatch covers are placed on top of the coaming structure. The coaming structure, the hatch covers, a cleating system and if necessary in combination with a rubber sealing system will ensure the cargo holds are weathertight.

Hatch covers serve dual purposes. Not only do they close off the interior of the ship, i.e. the cargo holds, from the elements, they also provide a support surface on which further cargo, for example containers, may be placed and stacked on top of each other. Obviously the weight of the containers, sometimes stacked 5 or more containers high, on the hatch covers result in severe loading of the edges of the cover and the top surface of the coaming structures.

Further, as the ships sails the hull flexes, i.e. rolls and pitches due to the seaway, i.e. the waves and/or cargo loads. Flexing of the hull causes a relative motion between the hatch cover and the coaming structure, and this relative motion must be accommodated whilst still properly transferring the weight of the hatch cover and the weight of the cargo on the hatch cover to the hull.

Traditionally hatch cover support pads made of steel, bronze-Teflon®, composite and plastic have been used. In these cases hatch cover support pads are mounted either to the edge of the hatch cover or on the coaming structure. In both cases each hatch cover support pad contacts a mating surface mounted on the top surface of the coaming structure or the edge of the hatch cover, the mating surface working as a bearing surface or mating plate. Because of the relative motion between the hatch covers and the coaming structure the hatch cover support pads move or slide over the mating surface.

The hatch cover or coaming structure further typically comprises a rubber seal for preventing ingress of water between the hatch cover and the coaming structure. Hatch cover support pads limit the compression of the rubber seal, thus prolonging the lifetime of the rubber seal.

For higher loads and bigger relative movements, as is the case on bigger cargo ships, the wear and friction of steel hatch cover support pads is so big that other types of hatch cover support pads are employed. These include bronze-Teflon® (polytetrafluoroethylene) hatch cover support pads, pads having a wear layer of woven Teflon® fibres, and in particular hatch cover support pads moulded from abrasion resistant plastics.

Different types of hatch cover support pads and arrangements of hatch cover support pads are disclosed from inter alia WO10023930, KR20100000621, CN101469514, WO9836073, JP10181677, DE29619940 and WO9501903.

Hatch cover support pads moulded from abrasion resistant plastics typically have high abrasion resistance and low friction, i.e. a long lifetime, and can support large loads. They are however expensive due to the materials from which they are made. A large cargo ship may have hundreds up to thousands of hatch cover support pads that must be replaced when worn out. Typically hatch cover support pads must be replaced when they have worn down 3-5 mm as then there will be a risk that the side skirt, or edge, of the hatch cover and/or the mating surface is resting on the coaming structure and/or hatch cover support pad holder taking away the effects of the hatch cover support pads. This could mean that high forces are transferred into the ship's hull structure, coaming structures and hatch covers, possibly causing damage to the steel structures of the hull.

However, it is often difficult to inspect and to determine wear on the hatch cover support pads. When the hatch covers are placed on the coaming structures, as is generally the case unless the particular cargo hold is being loaded or unloaded, only a small part of the hatch cover support pads are visible. The environment at sea further inconveniences the measuring of wear as the salt water causes corrosion of metal structures such as the coaming structure, the hatch cover and the hatch cover support pad holder while also water and ice makes it difficult to properly inspect the hatch cover support pads.

It is known to provide the sliding surface of the hatch cover support pads with grooves such that the grooves disappear when the sliding surface has been worn down to the level of the bottom of the grooves. However, the grooves may be difficult to see as plastic material that is worn off of the sliding surface may accumulate in the grooves.

Another problem when trying to determine wear of the hatch cover support pads is the great number of hatch cover support pads. It is thus difficult for workmen to properly and securely identify hatch cover support pads needing replacement.

It is therefore an object of the present invention to decrease the cost of hatch cover support pads.

It is a further object of the present invention to provide a hatch cover support pad, the wear of which is more easily determined.

It is a further object of the present invention to enable better control of wear of hatch cover support pads on a ship.

At least one of the above objects, or at least one of any of the further objects which will be evident from the below description, are according to a first aspect of the present invention achieved by the multi-layer hatch cover support pad according to claim 1.

By comprising the second polymer material, which is less abrasion resistant than the first plastic material, the base layer may be made from less expensive materials. This is possible as it is only the wear surface of the wear layer that must have high abrasion resistance. The base layer only has to support the wear layer. In other words the first plastic material is more suitable, in terms of abrasion resistance, toughness, friction etc., for sliding against the mating surface than the second polymer material. Accordingly the amount of the more expensive first plastic material in the multi-layer hatch cover support pad can be lowered as it is only the wear layer than needs to comprise the first plastic material, thereby lowering the cost of the multi-layer hatch cover support pad.

As an example a conventional plastic hatch cover support pad has a thickness of about 25 mm. A similarly sized multi-layer hatch cover support pad according to the first aspect of the present invention on the other hand may have a wear layer with a thickness of 5-10 mm thick (to accommodate a maximum permissible wear of 3-5 mm as described above), and a base layer having a thickness of 15-20 mm. Accordingly up to 80% of the hatch cover support pad may be made from the second polymer material, which, as it is less abrasion resistant than the first plastic material, is cheaper than the first plastic material. This results in a more economical hatch cover support pad.

Further, the second polymer material in the base layer may comprise recycled polymer material, further lowering costs and lowering the impact on the environment.

Where the maximum allowable wear is larger or smaller, the thickness of the wear layer may be adjusted correspondingly.

At the same time the multi-layer hatch cover support pad according to the first aspect of the present invention may have the same outer dimensions as the conventional plastic hatch cover support pad, and it may therefore easily replace the conventional plastic hatch cover support pad.

The shape and dimensions of the multi-layer hatch cover support pad depend on the materials used and the size and weight of the hatch cover and the cargo on the hatch cover, and may therefore vary. As an example the multi-layer hatch cover support pad may be generally rectangular in shape and have a generally planar wear surface and a generally planar fourth side. The multi-layer hatch cover support pad may have a length of about 15-25 cm, a width of about 5-15 cm and a thickness (when in un-worn state) of about 1.5 to 4 cm. Of the thickness of the multi-layer hatch cover support pad the wear layer makes up about 0.5 to 1 cm and the base layer makes up the remaining thickness. The thickness of the wear layer should be at least as large as the maximum allowable wear for the specific hatch cover and coaming structure the multi-layer hatch cover support pad is to be used with.

The above thicknesses refer to the multi-layer hatch cover support pad in unworn state, the abrasion caused by the wear surface sliding against the mating surface causes material to be removed from the wear layer and a resulting decrease in thickness of the wear layer.

The multi-layer hatch cover support pad preferably comprises a through-going bore, the through-going bore preferably extending transversely through the base layer and parallel to the wear layer, the through going bore being suitable for receiving an elongated locking member such as a locking pin or locking screw for allowing the multi-layer hatch cover support pad to be secured in a hatch cover support pad holder having a wall defining a pad receiving cavity, the wall having at least one hole in registration with the through-going bore of the multi-layer hatch cover support pad when mounted in the pad receiving cavity, the hole being suitable for allowing the elongated locking member to pass through it and into the multi-layer hatch cover support pad in the pad receiving cavity.

The multi-layer hatch cover support pad is suitable for supporting the hatch cover on the coaming structure by being interposable between the hatch cover and the coaming structure to thereby transfer the forces caused by the relative movement together with the weight of the hatch cover, including any cargo provided on the hatch cover, onto the coaming structure.

The hatch cover may have different sizes and may be rectangular or any other shape. The multi-layer hatch cover support pad may be provided on one of the hatch cover or the coaming structure and the mating surface is provided on the other.

The ship may be a cargo ship.

The outer wear surface encompasses the upper surface.

The mating surface is preferably smooth and generally planar and is preferably made from stainless steel. In the context of the present invention sliding against the mating surface encompasses contacting the mating surface.

The first plastic material preferably comprises a mixture of poly amide resin, polytetrafluoroethylene (PTFE) resin and silicone polymer. The first plastic material is preferably self-lubricating. The first plastic material may be reinforced with carbon, glass, aramide or other synthetic fibres; however, the wear layer preferably contains only the first plastic material.

The fourth side encompasses the underside of the multi-layer hatch cover support pad. The third side is joined to the second side, preferably by moulding.

The second polymer material should be of sufficient strength and rigidity to support the wear layer. The strength and rigidity of the second polymer material may for example be similar to those of nylons such as nylon 6,6.

The second polymer material may comprise rubber, silicone or plastic material. The rubber may comprise hard rubber.

Preferably the second polymer material comprises a plastic material such as a polyamide resin.

The second polymer material being less abrasion resistant than the first plastic material is to be understood as encompassing the second polymer material being less abrasion resistant, to abrasion caused between the mating surface and the multi-layer hatch cover support pad due to relative motion between the coaming structure and the hatch cover, than the first plastic material.

It is contemplated within the context of the present invention that the second polymer material may be chosen amongst materials that cause a squeal or other noise when sliding over the mating surface. In this way the second polymer material may serve to indicate when the wear layer has been worn off.

The multi-layer hatch cover support pad has at least two layers, thus the multi-layer hatch cover support pad may have more layers than the wear layer and the base layer.

Claim 2 further defines the first plastic material and the second polymer material in terms of their abrasion resistance. Preferably the geometrically identical bodies comprise identical cubes made from the respective materials and the loss of material may be measured in terms of weight, or the change in dimensions, of the geometrically identical bodies after having slid the distance against the mating surface when subjected to equal contact forces. The contact force is the force between the geometrically identical body and the mating surface.

The abrasion resistance may for example be expressed as the loss of material in mm thickness of a body when slid a certain distance in m against the mating surface when subjected to a certain contact force in Newton (N). The contact area between the body and the mating surface may be combined with the contact pressure resulting in a contact pressure ($N/mm^2$), thus the abrasion resistance may be expressed as loss of thickness of the body when slid a certain distance along the mating surface at a certain contact pressure.

In terms of abrasion resistance the first plastic material preferably has an abrasion resistance, i.e. loss of thickness, that is less than 0.1 μm when slid 1 m over a steel mating surface at a contact pressure of 50 MPa (50 $MN/m^2$).

Claim 3 defines a preferred embodiment of the multi-layer hatch cover support pad according to the first aspect of the present invention. The moulded multi-layer hatch cover support pad is easy and economical to manufacture and ensures that the base layer and the wear layer are strongly joined to prevent any delamination of the wear layer from the base layer.

Claim 4 defines a preferred embodiment of the multi-layer hatch cover support pad according to the first aspect of the present invention. By comprising the deformable bottom layer the multi-layer hatch cover support pad can accommodate uneven pressure of the mating surface against the multi-layer hatch cover support pad.

The sixth side encompasses a bottom surface.

The fifth side is preferably attached to said fourth side by being joined to said fourth side by moulding.

The material of the deformable bottom layer comprise a plastic material, however, it may also, or alternatively, comprise a rubber material.

The compressive strength of the second polymer material and the material of the deformable bottom layer may be determined by measuring the amount of deformation that is caused in the material when subjected to a certain force.

In some cases an interface layer, preferably comprising metal such as steel and interposed between the deformable bottom layer and the base layer, may be provided in the multi-layer hatch cover support pad. This may help in achieving uniform distribution of force from the base layer onto the deformable bottom layer if the base layer or deformable bottom layer comprises voids or cavities in order to reduce material consumption or weight. An interface layer is however not needed when the base layer and the deformable bottom layer are massive, i.e. comprising no such voids or cavities.

Claim 5 defines a preferred embodiment of the multi-layer hatch cover support pad according to the first aspect of the present invention. By providing engagement structures on the third side of said base layer the strength of the joining of the wear layer to the base layer is enhanced.

The engagement structures may comprise grooves or cavities extending from the third side into the base layer such that the first plastic material of the wear layer may fill these grooves or cavities, thereby increasing the area of contact between the first plastic material and the second polymer material. Preferably, however, the engagement structures protrude from the third side into the wear layer. The engagement structures therefore may comprise cylinders which may be provided with threads or ribs. Preferably the engagement structures are mushroom shaped comprising a stem protruding from the third side having a head defining an undercut.

Claim 6 defines a preferred embodiment of the multi-layer hatch cover support pad according to the first aspect of the present invention. By including the wear indicator body in the wear layer at the first distance from the wear surface the wear indicator body becomes visible, i.e. is revealed, when the wear layer has been worn down the first distance. As the wear indicator body is made from a material different from the first plastic material the appearance of wear indicator body on the wear surface is readily detectable by an operator of the ship, thereby conclusively and positively indicating that the wear layer has been worn down the first distance.

In the context of the present invention a material different from the first plastic material is to be understood as encompassing a material having a different appearance, such as due to colour or texture, from the first plastic material. The wear indicator body may thus be made from metals, a plastic material having a colour different from that of the first plastic material, etc. For example the wear indicator body may be made from the second polymer material provided the second polymer material has a different appearance than the first plastic material. In some embodiments the wear indicator body may be constituted by an attachment structure as defined above.

The wear indicator body is preferably included in the wear layer by moulding. In this case the wear indicator body may be a solid object that is placed in a mould before the first plastic material in liquid or melted form is introduced to the mould, or alternatively the wear indicator may be moulded in the mould. Further the wear indicator body may be included in the wear layer by being placed in a hole or channel provided or manufactured in the wear layer.

Preferably more than one, such as 4 or more, wear indicator bodies are provided in the wear layer.

Although the wear indicator body in claim 6 is defined as being featured in a preferred embodiment of the multi-layer hatch cover support pad according to the first aspect of the present invention, also a conventional plastic hatch cover support pad, i.e. a hatch cover support pad having a wear layer and a base layer both made from the first plastic material, i.e. effectively a single-layer hatch cover support pad (the wear layer makes up the full thickness of the hatch cover support pad), may include the wear indicator body as defined in claim 6 and described above. Further a method of producing a conventional plastic hatch cover support pad may comprise the step of moulding the first plastic material into the conventional hatch cover support pad and including the wear indicator body in the conventional hatch cover support pad.

Claim 7 defines a preferred embodiment of the multi-layer hatch covers support pad according to the first aspect of the present invention. The identification unit allows the multi-layer hatch cover support pad to be uniquely identified, thus enabling a ship operator to effectively keep track of the status of the individual multi-layer hatch cover support pads used on a ship to properly detect and monitor wear of the individual multi-layer hatch cover support pads and to be able to determine, based on the pattern of wear on the multi-layer hatch cover support pads, whether any hatch cover or coaming structure has been warped or otherwise damaged resulting in abnormal wear of individual multi-layer hatch cover support pads.

The identification information may comprise a serial number assigned to the individual multi-layer hatch cover support pad during manufacture and/or sale. Alternatively the identification information may be created by the ship operator and thereafter provided to the multi-layer hatch cover support pad.

Preferably each multi-layer hatch cover support pad manufactured has a unique identification information. However, in the context of the present invention uniquely identifying said multi-layer hatch cover support pad is to be understood as encompassing uniquely identifying a multi-layer hatch cover support pad amongst other multi-layer hatch cover support pads used on a ship. Thus the identification information may comprise a simple number provided that all multi-layer hatch cover support pads on a ship have identification information comprising different numbers.

Claim 8 defines a preferred embodiment of the multi-layer hatch cover support pad according to the first aspect of the present invention. By providing the identification unit within the multi-layer hatch cover support pad the identification unit is protected from damage due to the rough conditions at sea.

Preferably the identification unit is provided at a second distance from the wear surface. This second distance should be larger than the first distance to ensure that the multi-layer hatch cover support pad may be identified also when the wear layer has been worn down the first distance. If the second distance is selected so that the identification unit is provided at least partly within the wear layer it is achieved that the identification unit may serve also as a secondary wear indicator by being destroyed, so that the multi-layer hatch cover support pad may no longer be identified, when the wear layer has been worn down both the first distance and the second distance.

Alternatively the second distance can be adapted so that the identification unit is provided in the base layer. In this case, even if the wear layer is completely worn off, the multi-layer hatch cover support pad can still be identified provided the multi-layer hatch cover support pad has not been worn down the second distance.

It is further contemplated within the context of the present invention that further identification units, comprising different identification information and provided at further different distances from the wear surface, may be used to provide both identification information and an indication of wear off the multi-layer hatch cover support pad.

When the identification unit is provided within the multi-layer hatch cover support pad it may be accessed, for reading out the identification information, using electrical wires extending to the exterior of the multi-layer hatch cover support pad, using wireless communication between a reader and the identification unit, or by withdrawing the identification unit from a void within the multi-layer hatch cover support pad through a channel connecting the void with the exterior of the multi-layer hatch cover support pad.

Claim 9 defines a preferred embodiment of the multi-layer hatch cover support pad according to the first aspect of the present invention. An identification unit configured for wireless reading of the identification information simplifies and speeds up the process of identifying the individual multi-layer hatch cover support pads.

Preferably the identification unit comprises a RFID tag. The RFID tag comprises a memory and an antenna for transmitting the identification information encoded in the memory. The RFID tag may be powered by a battery or may alternatively comprise an antenna for converting a RF field emitted by a reader to electrical energy for reading the memory and transmitting the identification information.

Claim 10 defines an alternative embodiment of the preferred embodiment of the multi-layer hatch cover support pad according to the first aspect of the present invention as defined in claim 7. Providing the identification unit on an exterior surface of the multi-layer hatch cover support pad allows the identification unit to be more easily accessible, especially when the identification unit for example comprises a barcode, a printed, moulded or engraved code, or a sticker. However, this also means that the identification unit is more affected by the rough environment at sea which may destroy the identification unit.

Although the identification unit in claims 7-10 is defined as being featured in a preferred embodiment of the multi-layer hatch cover support pad according to the first aspect of the present invention, also a conventional plastic hatch cover support pad, i.e. a hatch cover support pad having a wear layer and a base layer both made from the first plastic material, i.e. effectively a single-layer hatch cover support pad (the wear layer makes up the full thickness of the hatch cover support pad), may include the identification unit as defined in claims 7-10 and described above. Further a method of producing a conventional plastic hatch cover support pad may comprise the step of moulding the first plastic material into the conventional hatch cover support pad and providing the identification unit within, or on the exterior, of the conventional hatch cover support pad.

Claim 11 defines a preferred embodiment of the multi-layer hatch cover support pad according to first aspect of the present invention. By having the second polymer material comprising a plastic material the wear layer and the base layer may be produced from similar materials which may be more strongly joined to each other by for example moulding.

At least one of the above objects, or at least one of any of the further objects which will be evident from the below description, are according to a second aspect of the present invention achieved by the method of producing a multi-layer hatch cover support pad according to claim 12.

The steps are preferably performed sequentially.

The second polymer material may be moulded into the base layer in a first mould, whereafter the moulded base layer is transferred to a second mould in which the first plastic layer is moulded onto the third side for the wear layer. Alternatively the first plastic material and the second polymer material may be moulded in a single mould either by simultaneous introduction of the first plastic material and the second polymer material into the mould, or by sequentially introducing the first plastic material and the second polymer material. The attachment structures are preferably formed using a mould having a side, corresponding to the third side, which side comprise the negative or positive impression of the attachment structures.

The deformable bottom layer may be moulded before or after moulding the base layer using a mould separate from the mould used for moulding the base layer, or alternatively the deformable bottom layer, the base layer and the wear layer may be moulded in a single mould by sequentially introducing the material of the deformable bottom layer, the second polymer material, and the first plastic material.

The wear indicator body may be produced by moulding it in a separate mould prior to moulding the base layer and the wear layer, or alternatively it may be moulded in the same mould as the base layer, optionally by moulding the base layer or the wear layer to include a cavity serving as a mould for the wear indicator body.

The identification unit may be placed in the mould before introducing the first plastic material and the second second polymer material. Alternatively the identification unit may be premixed with the first plastic material or the second polymer material introduced into the mould or added to the mould after introducing the first plastic material and the second polymer material but before the first plastic material and/or the second polymer material have solidified.

At least one of the above objects, or at least one of any of the further objects which will be evident from the below description, are according to a third aspect of the present invention achieved by the use of a multi-layer hatch cover support pad according to claim 13.

To further limit the cost of using hatch cover support pads it is another object of the present invention to provide a better locking of the hatch cover support pad in the hatch cover support pad holder to prevent loss of the hatch cover support pad. This object is achieved by a locking screw for securing a hatch cover support pad to a hatch cover or a coaming structure, the hatch cover support pad comprising a through-going bore and the locking screw being adapted to be screwed into the through-going bore, the locking screw comprising an elongated body having a point and an opposite head, the head defining a tool receiving recess such as a torx drive for driving and turning the locking screw, the locking screw further comprising, on a middle section between the point and the head, a screw thread, the screw thread being divided into screw thread segments by a lengthwise groove, such as a flute, extending along and curving around the middle section.

As the groove curves around the middle section each thread segment, when the locking screw is screwed into the through going bore in the hatch cover support pad, cuts material from the inner wall of the through-going bore. The cut material accumulates in the groove and thereby increases the force necessary to unscrew the locking screw, thereby increasing the security of the fastening of the hatch cover support pad.

The hatch cover support pad is preferably a multi-layer hatch cover support pad according to the first aspect of the present invention, but the locking screw according to the fourth aspect of the present invention may also be used with a conventional plastic hatch cover support pad.

The hatch cover support pad may be secured to the hatch cover or the coaming structure by being secured in a hatch cover support pad holder attached to the hatch cover or the coaming structure, the hatch cover support pad holder comprising a wall defining a pad receiving cavity, a hole being provided in the wall for lining up with the through-going bore of the hatch cover support pad for passing the locking screw through the hole for screwing it into the through-going bore.

The locking screw is preferably made from stainless steel. The middle section typically makes up about half of the length of the locking screw. The groove preferably curves halfway around the middle section.

At least one of the above objects, or at least one of any of the further objects which will be evident from the below description, are according to a fifth aspect of the present invention achieved by the use of the locking screw according to the fourth aspect of the present invention for securing a hatch cover support pad, preferably according to the first aspect of the present invention, to a hatch cover or a coaming structure, the hatch cover support pad comprising a through-going bore and the locking screw being adapted to be screwed into the through-going bore.

Figure 2:
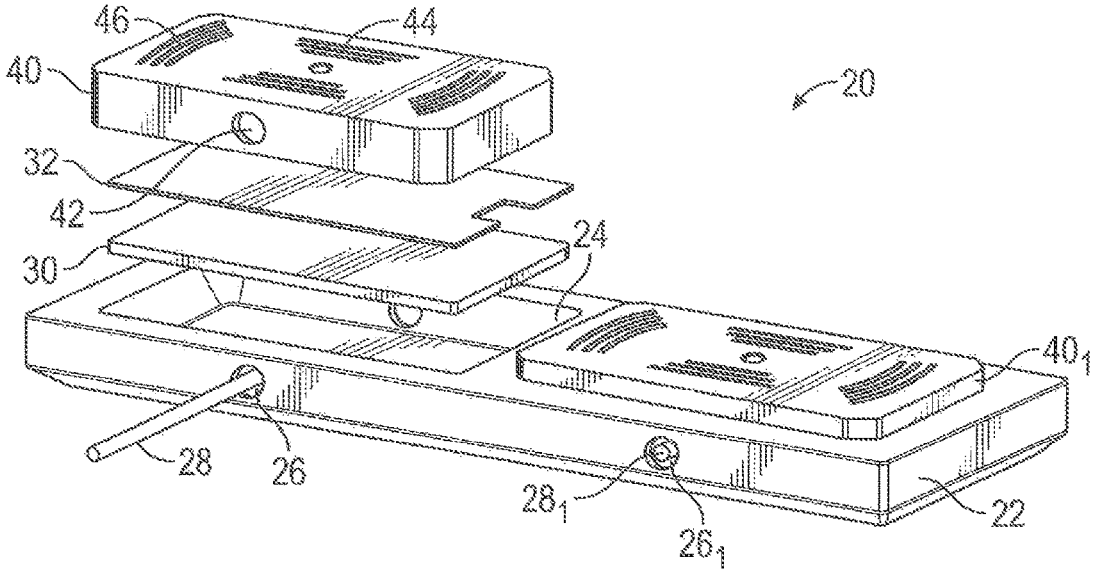
FIG. 2 (Prior Art)

The invention and its many advantages will be described in more detail below with reference to the accompanying schematic drawings, which for the purpose of illustration show some non-limiting embodiments, in which:

FIG. 1 shows, in perspective view, a conventional cargo ship with hatch covers and containers stacked on top of the hatch covers, the hatch covers being supported by conventional hatch cover support pads, FIG. 2 shows, in perspective view, a conventional hatch cover support assembly comprising a hatch cover support pad holder for holding two conventional hatch cover support pads.

Figure 3A:
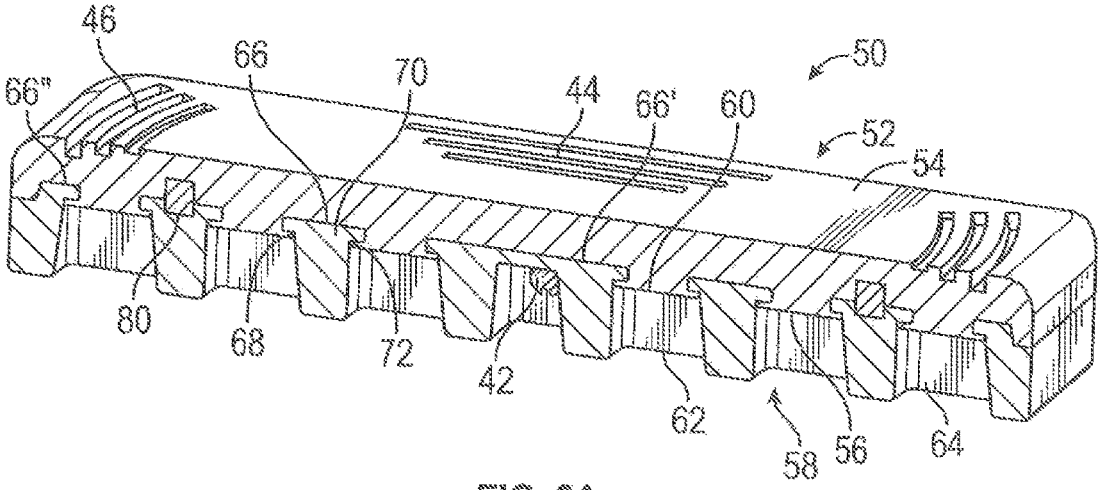
Figure 3B:
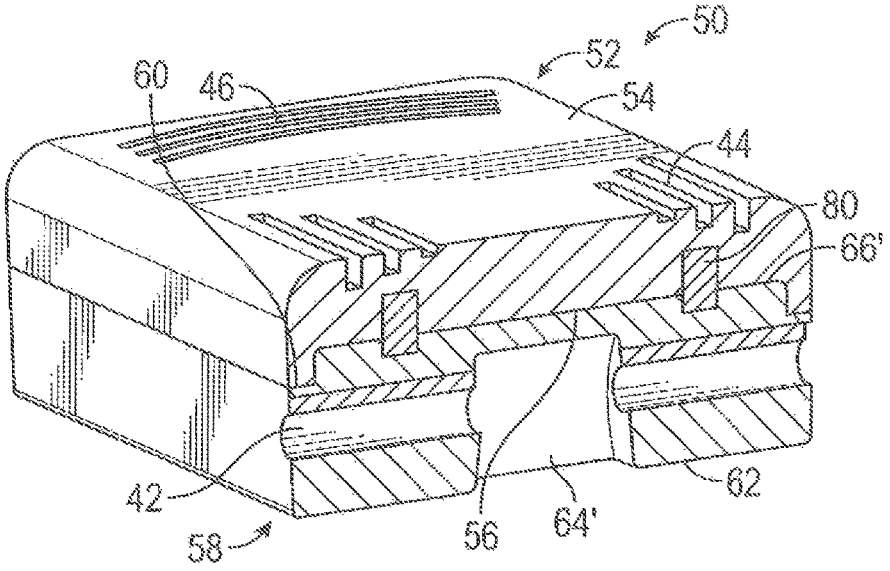
Figure 3C:
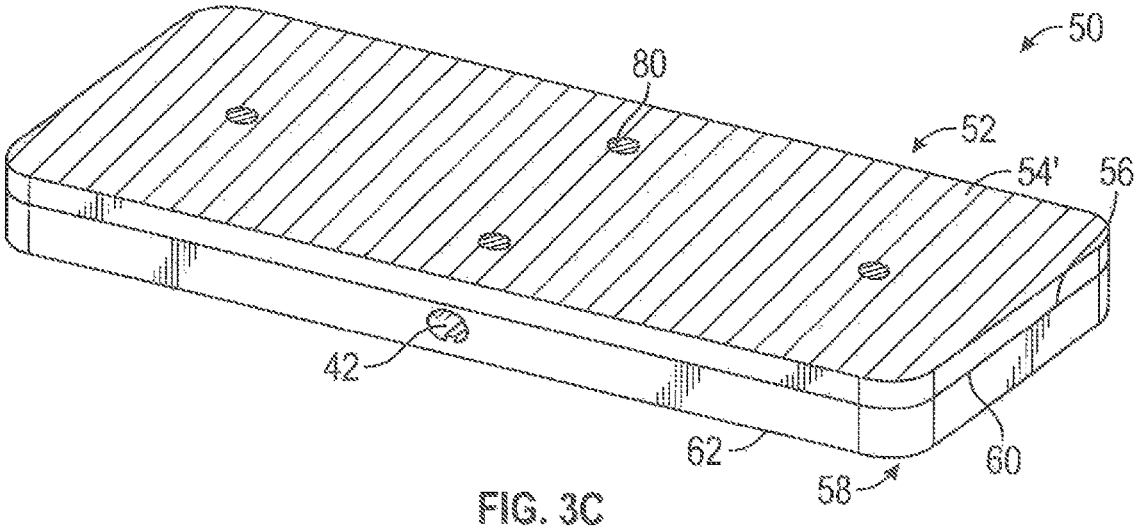

FIG. 3A shows a first cross section of a first embodiment of a hatch cover support pad according to the first aspect of the present invention, FIG. 3B shows a second cross section of the first embodiment of the hatch cover support pad according to the first aspect of the present invention, FIG. 3C shows a third cross section of the first embodiment of the hatch cover support pad according to the first aspect of the present invention, the third cross section corresponding to the appearance of the hatch cover support pad once the wear layer has been worn down to expose the wear indicators.

Figure 4:
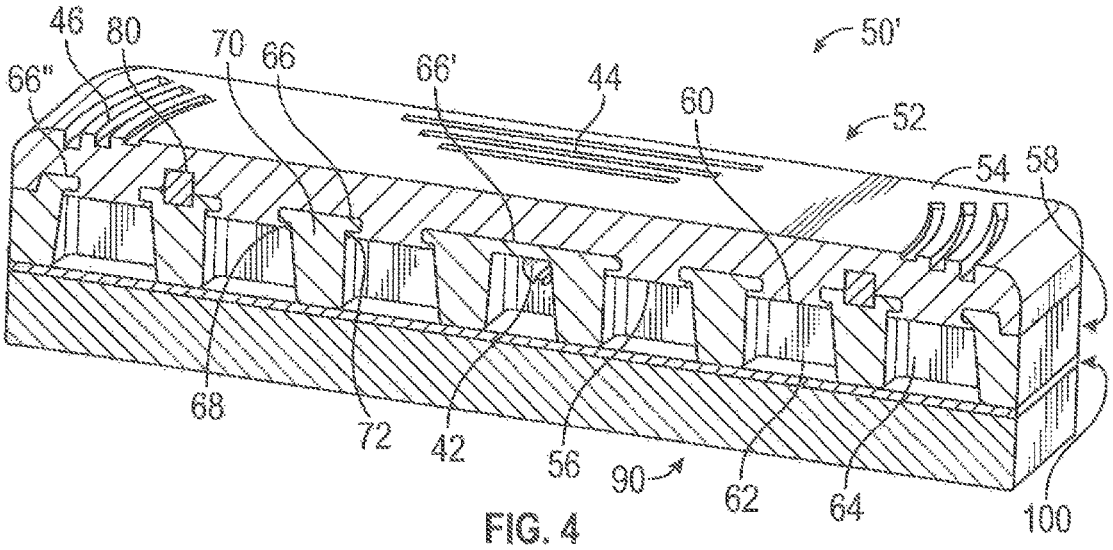
Figure 5A:
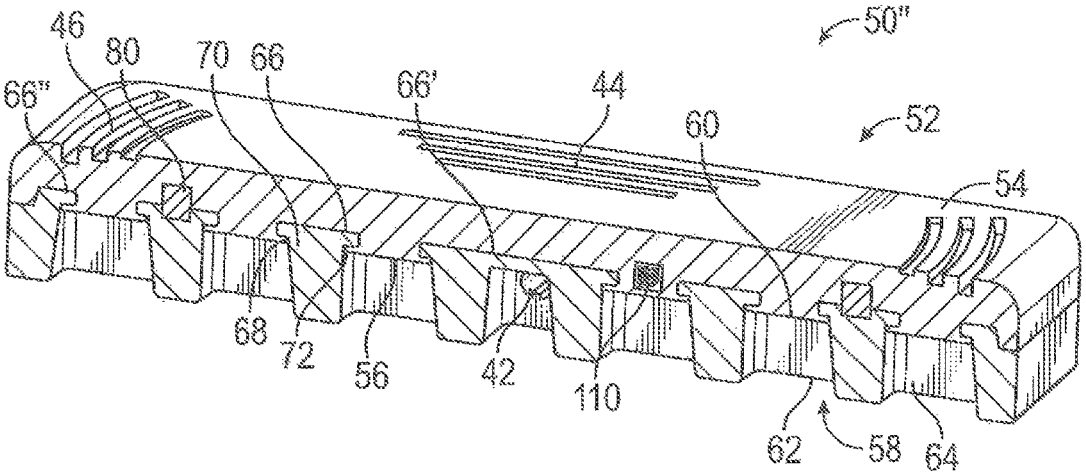
Figure 5B:
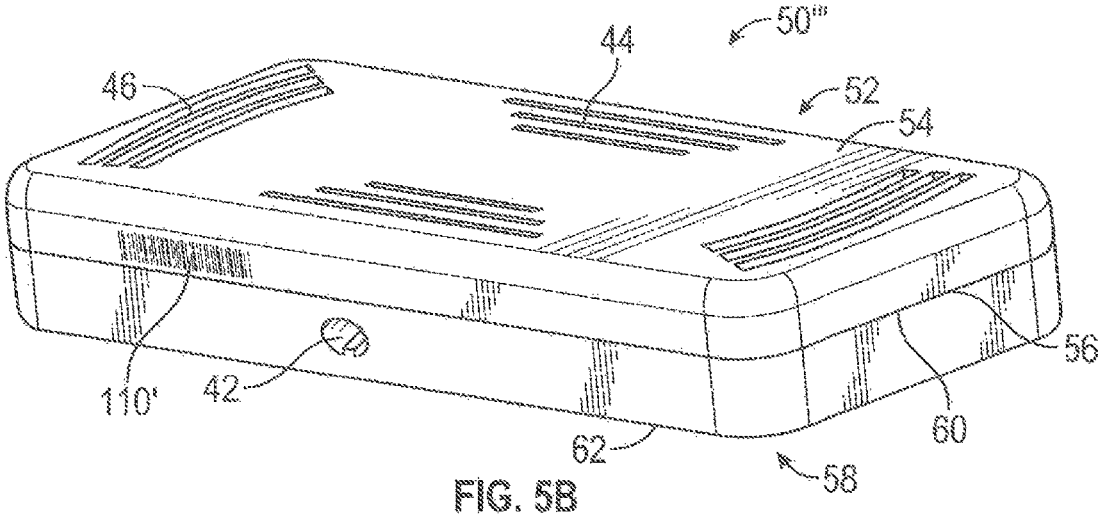
Figure 6:
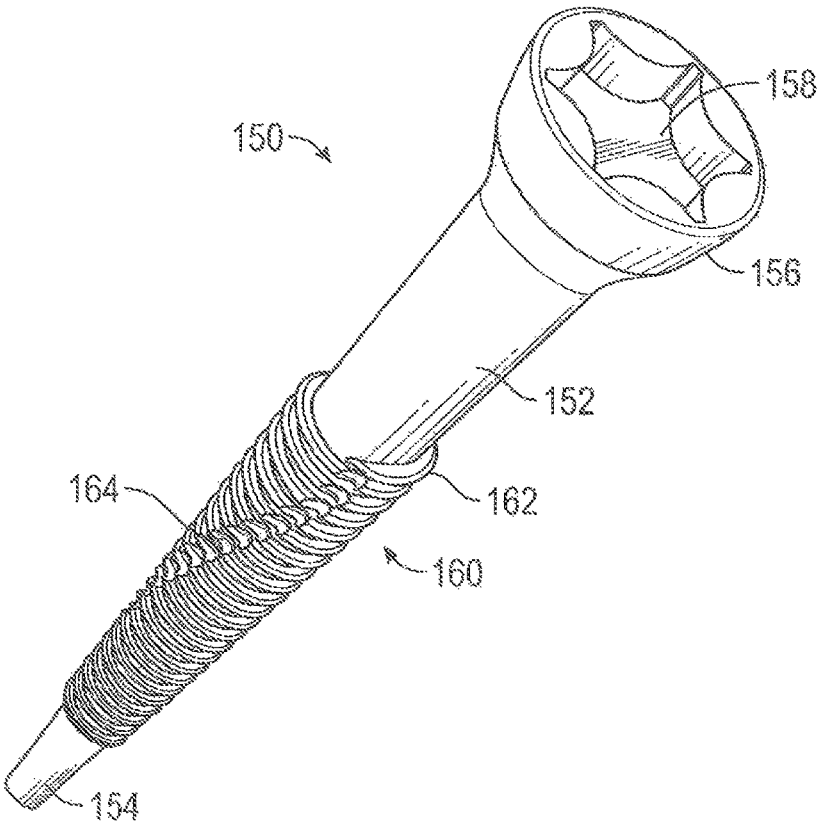

FIG. 4 shows a first cross section of a second embodiment of the hatch cover support pad according to the first aspect of the present invention, the second embodiment additionally comprising a deformable bottom layer and an interface layer, FIG. 5A shows a first cross section of a third embodiment of the hatch cover support pad according to the first aspect of the present invention, the third embodiment additionally comprising an identification chip, FIG. 5B shows, in perspective view, a fourth embodiment of the hatch cover support pad according to the first aspect of the present invention, the fourth embodiment additionally comprising a barcode on its exterior, and FIG. 6 shows, in perspective view, a locking screw for securing a hatch cover support pad in a hatch cover support pad holder.

In the below description, one or more signs added to a reference number indicates that the element referred to has the same or similar function as the element designated the non-modified reference number, however, differing in structure.

In the below description, where suitable for discussing a plurality of identical elements, a subscript Arabic numeral added to a reference number indicates that the element referred to is a further one of the element designated the non-subscripted reference number.

When further embodiments of the invention are shown in the figures, the elements which are new, in relation to earlier shown embodiments, have new reference numbers, while elements previously shown are referenced as stated above. Elements which are identical in the different embodiments have been given the same reference numerals and no further explanations of these elements will be given.

FIG. 1 shows, in perspective view, a conventional cargo ship 2 comprising a hull 4 having a deck 6. In the deck are formed hatch openings through which the ship's cargo holds may be accessed. The hatch openings are closed by hatch covers, one of which is designated the reference numeral 8 which are placed on the coaming structures, one of which is designated the reference numeral 10, which border the hatch openings in the hull 4. Containers, one of which is designated the reference numeral 12 are loaded in the cargo holds below the hatch covers (not shown) and also stacked on top of the hatch covers. The containers 12 are fastened to the hatch covers and lashed together as is known in the art of cargo shipping.

As the cargo ship 2 sails it will pitch and roll due to the seaway. This causes flexing of the hull 4 with the result that the coaming structure 10 moves in relation to the hatch cover 8. For the cargo ship 2 shown in FIG. 1 this movement is conventionally accommodated by supporting the hatch cover 8 using a steel mating surface 14 provided on the coaming structure 10 and by providing a hatch cover support pad 16 in a hatch cover support pad holder 18 which is fastened to the hatch cover 8. As the hull 4 flexes the hatch cover support pad 16 slides back and forth over the steel mating surface 14 while transferring the weight of the hatch cover 8 with the containers 12 to the coaming structure 10.

FIG. 2 shows, in perspective view, a conventional hatch cover support assembly in its entirety designated the reference numeral 20. The hatch cover support assembly 20 comprises a hatch cover support pad holder 22 provided with two pad receiving cavities, one of which is designated the reference numeral 24. Holes, one of which is designated the reference numeral 26, are provided in the walls of the hatch cover support pad holder 22 between the exterior of the hatch cover support pad holder 22 and the interior of the pad receiving cavities 24 for receiving a rod-shaped locking pin 28. In the pad receiving cavity 24 is first placed an elastic support piece 30 followed by a metal shim plate 32 before a conventional plastic hatch cover support pad 40 is installed. The conventional plastic hatch cover support pad 40 comprises a through-going hole or bore 42, which, when the plastic hatch covers support pad 40 is installed in the pad receiving cavity 24, lines up with the hole 26 in the hatch cover support pad holder 22 for receiving the locking pin 28 for retaining the plastic hatch cover support pad 40. The conventional plastic hatch cover support pad 40 further comprises on its wear surface, i.e. the upper surface of the conventional plastic hatch cover support pad 40, first and second sets of three wear indicating grooves 44 and 46, each of the three grooves having different depths to facilitate measuring the wear on the conventional plastic hatch cover support pad 40.

As stated above the conventional plastic hatch cover support pad 40 is expensive as the plastic material used is expensive due to the high demands on abrasion resistance for the plastic material used. Further it is difficult to detect wear using the set of grooves 44 and 46 because as plastic material is worn off the wear surface, the worn off material may accumulate in the grooves, FIG. 3A shows a first cross section of a first embodiment of a multi-layer hatch cover support pad 50 according to the first aspect of the present invention. The multi-layer hatch cover support pad 50 may be used instead of the conventional plastic hatch cover support pad 40 in the conventional hatch cover support assembly 20.

The multi-layer hatch cover support pad 50 comprises two layers, a wear layer 52 having a first side defining a wear surface 54 for sliding over the steel mating surface 14 and an opposite second side 56, and a base layer 58 having third and fourth sides 60 and 62 for supporting the wear layer 52. The wear layer 52 is made from a first plastic material, in this case a self-lubricating, highly abrasion resistant and low friction plastic material while the base layer is made from a second polymer material which is less abrasion resistant than the first plastic material and which is more economical than the first plastic material. Thus the multi-layer hatch cover support pad 50 is more economical as it uses less of the expensive first plastic material than the conventional plastic hatch cover support pad 40.

The third side 60 of the base layer 58 is joined to second side 56 of the wear layer 52 while the opposite fourth side 62 in use contacts the metal shim plate 32.

The multi-layer hatch cover support pad 50 may, as shown in FIGS. 3A and 3B comprise blind holes, one of which is designated the reference numeral 64, open to the fourth side 62 and being provided in the base layer 58 for reducing the weight of the multi-layer hatch cover support pad 50.

The multi-layer hatch cover support pad 50 further comprises the through-going hole 42 of the conventional plastic hatch cover support pad 20.

To increase the strength of the adhesion between the wear layer 52 and the base layer 58 the third side 60 of the base layer 58 comprises mushroom shaped engagement units, one of which is designated the reference numeral 66, each of which comprises a stem 68 extending from the third side 60 and being terminated in an engaging head 70 extending beyond the diameter of the stem 68 to define an undercut 72. The engaging head 70 with the undercut 72 serve to anchor the wear layer 52 to the base layer 58 as part of the first plastic material of the wear layer 52, during moulding of the wear layer 52 to the base layer 58, becomes trapped by the undercut 72 beneath the engaging head 70. FIG. 3A also shows alternative engagement units 66' and 66".

The multi-layer hatch cover support pad 50 may, as shown in FIGS. 3A and 3B, comprise the first and second sets of three wear indicating grooves 44 and 46, however the wear indicating grooves 44 and 46 are not essential to the multi-layer hatch cover support pad 50.

As described above it may be difficult to properly detect the wear of the wear surface 54 using the sets of three grooves 44 and 46.

Therefore the hatch cover support pad 50 further, or instead, comprises a plurality of internal wear indicator bodies, one of which is designated the reference numeral 80. The wear indicator body 80 comprises a body of a material which is different from the first plastic material, such as having a colour or texture which is different from the colour or texture of the wear layer 52. As the wear indicator body is placed within the multi-layer hatch cover support pad 50 a first distance, such as 3-5 mm, from the wear surface 54 of an unworn multi-layer hatch cover support pad 50, wear on the wear surface 54 will eventually result in the wear indicator body becoming visible as can be seen in FIG. 3C. This clearly indicates that the multi-layer hatch cover support pad 50 is worn out and needs to be replaced.

In contrast to the sets of three grooves 44 and 46 the wear indicator body 80 is less likely to be fouled by the worn off plastic material.

As shown in FIG. 3A the wear indicator body 80 may preferably be attached to the mushroom shaped engagement units 66, however the wear indicators 80 may alternatively be integral with the base layer 58 and extend from the third side 60. In particular the wear indicator body 80 may be formed integral with the mushroom shaped engagement units 66, as a body extending from the mushroom shaped engagement units 66.

FIG. 3B shows a second cross section of the first embodiment of the multi-layer hatch cover support pad 50 according to the first aspect of the present invention, FIG. 3C shows a third cross section of the first embodiment of the multi-layer hatch cover support pad 50 according to the first aspect of the present invention, the third cross section corresponding to the appearance of the multi-layer hatch cover support pad once the wear layer 52 has been worn down enough, typically 3-5 mm and depending on the first distance, to expose the wear indicator body 80. Preferably, as shown in FIG. 3C, several wear indicator bodies 80 are positioned in a cross formation with one wear indicator body 80 at each end of the multi-layer hatch cover support pad 50 and one wear indicator body 80 on each side of the longitudinal axis of the multi-layer hatch cover support pad 50.

Additional wear indicators 80 may be added to the multi-layer hatch cover support pad 50 in order to determine wear in other locations of the wear layer 52 and the wear surface 54. Further, wear indicator bodies 80 being positioned or adapted at different first distances to the wear surface 54 of an unworn multi-layer hatch cover support pad 50, may be used resulting in that different wear indicator bodies 80 become visible sequentially or gradually as the wear layer 52 is worn off, thereby indicating how much of the wear layer 52 has been worn off.

The wear indicator body 80 may also be used in the conventional plastic hatch cover support pad 40.

In operation the multi-layer hatch cover support pad 50 is used with the hatch cover support assembly 20 by being placed in the pad receiving cavity 24 of the hatch cover support pad holder 22. The height of the multi-layer hatch cover support pad 50 is adjusted by placing one or more metal shim plates 32 in the pad receiving cavity 24 below the multi-layer hatch cover support pad 50. Further an elastic support piece 30 may also be placed in the pad receiving cavity 24.

FIG. 4 shows a first cross section of a second embodiment of the multi-layer hatch cover support pad 50' according to the first aspect of the present invention, the second embodiment in addition to the first embodiment, comprising a deformable layer bottom 90 and a steel interface layer 100.

The deformable bottom layer 90 is attached to the base layer 58 by moulding and, as it is made of a material with less compressive strength than the second polymer material, ensures that the multi-layer hatch cover support pad 50' will be leveled evenly against the mating surface 14 in case the multi-layer hatch cover support pad 50' is not evenly pressed against the mating surface 14 due to unevenness in the coaming structure 10 or the hatch cover 8.

The steel interface layer 100 serves the purpose of ensuring an equal transfer of weight from the hatch cover onto the elastic layer 90 despite the presence of the blind holes 64 on the second side 62 of the base layer 58.

When the hatch cover support pad 50' is used with the hatch cover support pad holder 22 there is no need for the elastic support piece 30, however one or more metal shim plates 32 may still be needed to ensure the correct height of the hatch cover support pad 50'.

Although shown in FIG. 4, the steel interface layer 100 is not essential and may be dispensed with, resulting in a multi-layer hatch cover support pad comprising only the deformable bottom layer 90, the base layer 58 and the wear layer 52. In this case preferably the base layer 58 does not comprise the blind holes 64 but is rather instead formed as a massive piece. Alternatively the material of the deformable bottom layer 90 may occupy also the blind holes 64. In either case the whole multi-layer hatch cover support pad 50' becomes a single massive piece.

FIG. 5A shows a first cross section of a third embodiment of the multi-layer hatch cover support pad 50" according to the first aspect of the present invention, the third embodiment, in addition to the first embodiment, comprising an identification chip 110 representing an identification unit. The identification chip 110 is as shown in FIG. 5A moulded into the wear layer 52 at a second distance from the wear surface 54 such as a position below the upper ends of the wear indicators 80, i.e. further away from the wear surface 54 of the non-worn multi-layer hatch cover support pad 50" than the wear indicator body 80. However, the identification chip 110 may alternatively be moulded into the base layer 58 or be positioned at the interface between the wear layer 52 and the base layer 58.

The identification chip 110 comprises a RFID chip comprising a memory storing a unique identification code for the multi-layer hatch cover support pad 50" and an antenna for sending the unique identification code to a reader. The RFID chip may comprise a battery for powering the RFID chip and sending the unique identification code, or alternatively the RFID chip may comprise an antenna for receiving power from the reader.

The purpose of the identification chip 110 is to allow an operator of the cargo ship 2 to properly identify the multi-layer hatch cover support pad 50" so that the wear of each multi-layer hatch cover support pad 50", as determined using the set of three grooves 44 and 46 or using the wear indicators 80, can be correctly allocated to that specific multi-layer hatch cover support pad 50" out of the typically hundreds of multi-layer hatch cover support pads 50" that may be used on the cargo ship 2. This provides for securely keeping track of the wear of each and every hatch cover support pad 50" on the cargo ship 2 so that the multi-layer hatch cover support pad 50" may be exchanged when worn out and for allowing the identification of any structural anomalies of the hatch cover 8 or coaming structure 10 that may lead to un-equal wear of the multi-layer hatch cover support pads 50".

The position of the identification chip 110 shown in FIG. 5A, i.e. at a the second distance which is further away from the wear surface 54 of the non-worn multi-layer hatch cover support pad 50" than the wear indicator body 80, however still within the wear layer 52, has the advantage that the identification chip 110 may be used to indicate wear of the wear layer 52. As an unworn multi-layer hatch cover support pad 50" is exposed to wear the thickness of the first plastic material between the identification chip 110 and the wear surface 54 decreases, however the multi-layer hatch cover support pad 50" can still be identified with the reader. Once the wear layer 52 has been worn off, so much that the identification chip 110 is exposed, the friction and pressure between the multi-layer hatch cover support pad 50" and the mating surface 14 will destroy or render inoperable the identification chip 110, thus resulting in that the multi-layer hatch cover support pad 50" can no longer be identified with the reader which clearly indicates that the hatch cover support pad 50" must be exchanged.

FIG. 5B shows, in perspective view, a fourth embodiment of the multi-layer hatch cover support pad 50'" according to the first aspect of the present invention, the fourth embodiment, in addition to the first embodiment, comprising a barcode 110', representing an identification unit, on its exterior. The barcode 110', which is simpler and more economical than the identification chip 110, serves the same purpose as the latter of identifying the multi-layer hatch cover support pad 50'" and therefore comprises an unique identification code. By reading the barcode with a suitable barcode scanner the multi-layer hatch cover support pad 50'" may be properly identified and wear of the multi-layer hatch cover support pad 50'", as determined using the set of grooves 44 and 46 or using the wear indicator body 80, can be correctly allocated to that specific multi-layer hatch cover support pad 50'" and used as described above.

If desired the hatch cover support pad 50 may be provided with both an identification chip 110 within the hatch cover support pad 50 and a barcode 110' on the exterior of the hatch covers support pad 50.

Further the identification chip 110 and/or the barcode 110' may be used on the conventional plastic hatch cover support pad 40.

FIG. 6 shows, in perspective view, a locking screw 150 for securing the hatch cover support pad 40, 50, 50', 50" or 50'" in the hatch cover support pad holder 22. The locking screw 150 comprises an elongated body 152 having a point 154 and an opposite head 158, the head 158 defining a tool receiving recess 160 comprising a torx screw drive for allowing the locking screw 150 to be tightened. The locking screw 150 further comprises, on its middle section between the point 154 and the head 158 a screw thread 162. The screw thread 162 is non-continuous as it is divided into screw thread segments 164 by a lengthwise groove 164, such as a flute, extending along and curving around the middle section of the elongated body 152.

In contrast to the locking pin 28 shown in FIG. 2 the locking screw 150 provides a more secure fastening as it is screwed into the hatch cover support pad 40, 50, 50', 50" or 50'". Further, as the locking screw 150 is screwed into the hatch cover support pad 40, 50, 50', 50" or 50'" material is cut from the inner walls of the through-going hole 42 as each screw thread segment 164 in the area of the groove 164 engages the inner wall. As the groove curves around the elongated body 152 it is ensured that each screw segment 164 cut material from the inner wall of the through-going hole 42.

The cut material then accumulates in the groove 164 and its presence in the grove 164 increases the force necessary to unscrew the locking screw 150, thereby increasing the security of the fastening of the hatch cover support pad 40, 50, 50', 50" and 50'''.

LIST OF PARTS WITH REFERENCE TO THE FIGURES

2. Cargo ship
4. Hull
6. Deck
8. cover
10. Coaming structure
12. Container
14. Steel mating surface
16. Hatch cover support pad
16. Hatch cover support pad holder
20. Conventional hatch cover support assembly
22. Hatch cover support pad holder
24. Pad receiving cavity
26. Hole
28. Locking pin
30. Elastic support piece
32. Metal shim plate
40. Conventional plastic hatch cover support pad
42. Through-going hole
44. First set of three wear indicating grooves
46. Second set of three wear indicating grooves
50. Multi-layer hatch cover support pad
58. Wear layer
54. Wear surface
56. Second side
58. Base layer
60. Third side
62. Fourth side
64. Blind hole
64. Mushroom shaped engagement units
68. Stem
70. Engaging head
72. Undercut
80. Wear indicator body
90. Deformable bottom layer
100. Steel interface layer
110. Identification chip
150. Locking screw
152. Elongated body
154. Point
158. Head
160. Tool receiving recess
162. Screw thread
164. Screw thread segment
164. Groove

The invention claimed is:

1. A multi-layer hatch cover support pad for supporting a hatch cover on a coaming structure of a ship, said multi-layer hatch cover support pad comprising an outer wear surface for sliding against a mating surface provided on said hatch cover or said coaming structure, a wear layer comprising first and second opposite sides, said first side defining said outer wear surface, said wear layer comprising a first plastic material, and, a base layer comprising third and fourth opposite sides, said third side being joined to said second side, said base layer comprising a second polymer material, said second polymer material being less abrasion resistant than said first plastic material, said second side being joined, through moulding, to said third side.

2. The multi-layer hatch cover support pad according to claim 1, the abrasion resistance of said first plastic material and said second polymer material being determined by measuring loss of material from geometrically identical bodies of said first plastic material and said second polymer material slid equal distances against said mating surface when subjected to equal contact forces.

3. The multi-layer hatch cover support pad according to claim 1, said multi-layer hatch cover support pad further comprising a deformable bottom layer comprising fifth and sixth opposite sides, said fifth side being attached to said fourth side, said deformable bottom layer comprising a material having lower compressive strength than said second polymer material.

4. The multi-layer hatch cover support pad according to claim 1, said base layer on said third side comprising attachment structures for enhancing the strength of the joining of said wear layer to said base layer.

5. The multi-layer hatch cover support pad according to claim 1 further comprising at least one wear indicator body, said wear indicator body being made from a material different from said first plastic material, said wear indicator body being included in said wear layer at a first distance from said wear surface.

6. The multi-layer hatch cover support pad according to claim 1 further comprising an identification unit comprising identification information for uniquely identifying said multi-layer hatch cover support pad.

7. The multi-layer hatch cover support pad according to claim 6, said identification unit being provided within the multi-layer hatch cover support pad.

8. The multi-layer hatch covers support pad according to claim 7, said identification unit being configured for wireless reading of said identification information.

9. The multi-layer hatch cover support pad according to claim 6, said identification unit being provided on an exterior surface of the multi-layer hatch cover support pad.

10. The multi-layer hatch cover support pad according to claim 1, said second polymer material comprising a plastic material.

11. A method of producing a multi-layer hatch cover support pad for supporting a hatch cover on a coaming structure of a ship according to claim 1, the method comprising the steps of:

moulding a second polymer material into a base layer having opposite third and fourth sides, moulding a first plastic material onto said third side to form a wear layer having first and second opposite sides, said first side defining a wear surface and said second side being joined, through moulding, to said third side, said second polymer material, in solid form, being less abrasion resistant than said first plastic material in solid form.

12. Use of a multi-layer hatch cover support pad according to claim 1 for supporting a hatch cover on a coaming structure of a ship.

13. The multi-layer hatch cover support pad according to claim 2, said multi-layer hatch cover support pad being moulded.

14. The multi-layer hatch cover support pad according to claim 2, said multi-layer hatch cover support pad further comprising a deformable bottom layer comprising fifth and sixth opposite sides, said fifth side being attached to said fourth side, said deformable bottom layer comprising a material having lower compressive strength than said second polymer material.

15. The multi-layer hatch cover support pad according to claim 2, said base layer on said third side comprising attachment structures for enhancing the strength of the joining of said wear layer to said base layer.

16. The multi-layer hatch cover support pad according to claim 3, said base layer on said third side comprising attachment structures for enhancing the strength of the joining of said wear layer to said base layer.

17. The multi-layer hatch cover support pad according to claim 2 further comprising at least one wear indicator body, said wear indicator body being made from a material different from said first plastic material, said wear indicator body being included in said wear layer at a first distance from said wear surface.

* * * * *